US012104842B2

(12) United States Patent
Wang et al.

(10) Patent No.: US 12,104,842 B2
(45) Date of Patent: Oct. 1, 2024

(54) REFRIGERATOR HAVING CENTRIFUGAL FAN WITH VOLUTE

(71) Applicants: QINGDAO HAIER REFRIGERATOR CO., LTD., Shandong (CN); HAIER SMART HOME CO., LTD., Shandong (CN)

(72) Inventors: Jing Wang, Qingdao (CN); Shujuan Wu, Qingdao (CN); Shufei Ren, Qingdao (CN); Fa Zhao, Qingdao (CN); Toshinori Noda, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 299 days.

(21) Appl. No.: 17/434,328

(22) PCT Filed: Feb. 19, 2020

(86) PCT No.: PCT/CN2020/075881
§ 371 (c)(1),
(2) Date: Aug. 26, 2021

(87) PCT Pub. No.: WO2020/173354
PCT Pub. Date: Sep. 3, 2020

(65) Prior Publication Data

US 2022/0163250 A1 May 26, 2022

(30) Foreign Application Priority Data

Feb. 26, 2019 (CN) ..... 201910143307.X

(51) Int. Cl.
*F25D 17/06* (2006.01)
*F25D 17/08* (2006.01)

(52) U.S. Cl.
CPC ..... *F25D 17/067* (2013.01); *F25D 17/062* (2013.01); *F25D 17/08* (2013.01)

(58) Field of Classification Search
CPC ..... F25D 17/067; F25D 17/062; F25D 2317/0661; F25D 2317/0683
See application file for complete search history.

(56) References Cited

U.S. PATENT DOCUMENTS 2,089,608 A 8/1937 Horlacher
2,767,558 A * 10/1956 Wallenbrock ..... F25D 25/024 62/505

(Continued)

FOREIGN PATENT DOCUMENTS

CN 1677031 A 10/2005
CN 101038113 A 9/2007

(Continued)

OTHER PUBLICATIONS

International Search Report for PCT/CN2020/075881 (ISA/CN) mailed Apr. 26, 2020 with English translation (6 pages).

(Continued)

*Primary Examiner* — Schyler S Sanks
(74) *Attorney, Agent, or Firm* — Alston & Bird LLP

(57) ABSTRACT

Disclosed is a refrigerator having a centrifugal fan with a volute, which includes a cabinet, an evaporator, a centrifugal fan, and an air supply duct. A cooling chamber located at a lower part and at least one storage compartment located above the cooling chamber are defined in the cabinet; the evaporator is disposed in the cooling chamber and is configured to cool airflow entering the cooling chamber to form cooled airflow; the centrifugal fan includes a volute and an impeller disposed in the volute; and the air supply duct is detachably connected with the volute, communicates with a volute air outlet, and is configured to deliver the cooled airflow into the at least one storage compartment. In the (Continued)

refrigerator of the present invention, the cooling chamber is located at a lower part of the cabinet, so that the cooling chamber occupies a lower space in the cabinet; the storage compartment is located above the cooling chamber, a compressor chamber may be defined behind the cooling chamber, and the storage compartment no longer needs to make room for the compressor chamber, thus guaranteeing the storage volume of the storage compartment. In addition, the air supply duct and the centrifugal fan adopt a split design, which implements modularization, is convenient for disassembly, assembly and transportation, and improves the yield rate.

17 Claims, 9 Drawing Sheets

(56) References Cited

U.S. PATENT DOCUMENTS

| | | | | |
|---|---|---|---|---|
| 3,050,956 | A | 8/1962 | Mann et al. | |
| 5,662,394 | A | 9/1997 | Choi | |
| 6,272,876 | B1 * | 8/2001 | Roberts | F25D 17/067 454/193 |
| 8,522,565 | B1 * | 9/2013 | Hauck | F25D 19/02 62/448 |

FOREIGN PATENT DOCUMENTS

| | | | |
|---|---|---|---|
| CN | 101129237 | A | 2/2008 |
| CN | 202902682 | U | 4/2013 |
| CN | 202959687 | U | 6/2013 |
| CN | 106500438 | A | 3/2017 |
| CN | 106642935 | A | 5/2017 |
| CN | 106907889 | A | 6/2017 |
| CN | 106969568 | A | 7/2017 |
| CN | 107202462 | A | 9/2017 |
| CN | 206583190 | U | 10/2017 |
| CN | 107560287 | A | 1/2018 |
| CN | 110285629 | A | 9/2019 |
| CN | 110375494 | A | 10/2019 |
| CN | 209893738 | U | 1/2020 |
| DE | 3113571 | A1 | 11/1982 |
| EP | 2664873 | B1 | 8/2017 |
| FR | 1262851 | A | 6/1961 |
| FR | 2262913 | A1 | 10/1975 |
| KR | 1999-0057131 | A | 7/1999 |

OTHER PUBLICATIONS

Written Opinion of the International Searching Authority for PCT/CN2020/075881 (ISA/CN) mailed Apr. 26, 2020 with English translation (4 pages).

1st Office Action for Australia Patent Application No. 2020228085 dated Jun. 9, 2022 (3 pages).

1st Office Action for EP Application No. 20763756.2 dated Mar. 23, 2022 (6 pages).

Supplementary European Search Report for EP Application No. 20763756.2 dated Mar. 11, 2022 (4 pages).

Notice of Acceptance for Australia Patent Application No. 2020228085 dated Sep. 30, 2022 (3 pages).

2nd Office Action for EP Patent Application No. 20763756.2 dated Sep. 14, 2022 (6 pages).

Intention to Grant for EP Patent Application No. 20763756.2 dated Mar. 6, 2023 (44 pages).

1st Office Action including Search Report for China Patent Application No. CN 201910143307.X dated Jan. 11, 2024, w/English translation(.

* cited by examiner

REFRIGERATOR HAVING CENTRIFUGAL FAN WITH VOLUTE

TECHNICAL FIELD

The present invention relates to the technical field of household appliances, and in particular to a refrigerator having a centrifugal fan with a volute.

BACKGROUND ART

In an existing refrigerator, a freezing chamber is generally located at the lower part of the refrigerator, an evaporator is located at the rear part of the outer side of the freezing chamber, a compressor chamber is located at the rear part of the freezing chamber, and the freezing chamber needs to make room for the compressor chamber, so that the freezing chamber is in a special shape, which limits the depth of the freezing chamber.

SUMMARY OF THE INVENTION

In view of the above problems, an objective of the present invention is to provide a refrigerator that overcomes or at least partially solves the above problems.

A further objective of the present invention is to implement modularization of an air supply duct and a centrifugal fan, which is convenient for disassembly, assembly and transportation.

The present invention provides a refrigerator, which includes:

- a cabinet, in which are defined a cooling chamber located at a lower part and at least one storage compartment located above the cooling chamber;
- an evaporator, disposed in the cooling chamber and configured to cool airflow entering the cooling chamber to form cooled airflow;
- a centrifugal fan, including a volute and an impeller disposed in the volute, and configured to promote the cooled airflow to flow into the at least one storage compartment; and
- an air supply duct, detachably connected with the volute and communicating with a volute air outlet, and configured to deliver the cooled airflow into the at least one storage compartment.

Optionally, the centrifugal fan is located behind the evaporator, and the air supply duct is located at an inner side of a rear wall of the centrifugal fan.

The volute includes:

- a lower box body opened at both an upper part and a rear end and an upper cover body buckled on the lower box body and opened at both a lower part and a rear end, the rear end of the upper cover body and the rear end of the lower box body defining the volute air outlet.

The air supply duct includes a duct front cover plate located at a front side and a duct rear cover plate located at a rear side, the duct front cover plate is detachably connected with the upper cover body, and the duct rear cover plate is detachably connected with the lower box body.

Optionally, the duct rear cover plate includes a rear vertical plate section located at a lower part and vertically extending and a joint section bent and extending forwards and downwards from a lower end of the rear vertical plate section, and the joint section and a lower end of the duct front cover plate define a duct air inlet communicating with the volute air outlet.

The duct rear cover plate is detachably connected with the lower box body through the joint section.

Optionally, the joint section includes a horizontal straight section located at a front-most side and extending forwards and backwards, a first vertical plate vertically extending downwards is formed at a front end of the horizontal straight section, the first vertical plate extends from one transverse side of the horizontal straight section to the other side, and at least one first buckle protruding forwards is formed on a front vertical face of the first vertical plate.

A second vertical plate vertically extending downwards is formed at a rear end of a bottom wall of the lower box body, and the second vertical plate extends from one transverse side of the bottom wall of the lower box body to the other side.

First notches corresponding to and fitting with the at least one first buckle one-to-one are formed at a lower end of the second vertical plate.

The first buckle is buckled into the corresponding first notch and is hooked with a front vertical face of the second vertical plate, so as to assemble the lower box body and the duct rear cover plate.

Optionally, a third vertical plate extending upwards is formed at a rear end of a top wall of the upper cover body, and the third vertical plate extends from one transverse side of the top wall of the upper cover body to the other side.

The duct front cover plate includes a front vertical plate section located at the lower part and vertically extending, a transverse dimension of the front vertical plate section is equal to or greater than that of the third vertical plate, and at least one second buckle protruding forwards is formed on a front wall surface of the front vertical plate section.

At least one second notch corresponding to and fitting with the at least one second buckle one-to-one is formed at an upper end of the third vertical plate.

The second buckle is buckled into the corresponding second notch and is hooked with a front vertical face of the third vertical plate, so as to assemble the upper cover body and the duct front cover plate.

Optionally, a section defined by the rear vertical plate section and the joint section is marked as a lower plate section of the duct rear cover plate.

A sealing portion is formed at an inner side of each of two transverse ends of the lower plate section, and the two sealing portions both extend forwards into the volute, so as to seal two transverse sides of a junction of the duct air inlet and the volute air outlet.

Optionally, when the upper cover body and the lower box body are connected in a buckling manner, a side wall of the upper cover body is located at an inner side of a side wall of the lower box body, so as to define a volute duct in the volute by using the side wall of the upper cover body, the top wall of the upper cover body and the bottom wall of the lower box body.

Optionally, a volute air inlet is formed on the top wall of the upper cover body.

An included angle between a rotation axis of the impeller and a vertical line is 20° to 35°.

Optionally, a horizontal distance between a front end face of the volute and a rear end face of the evaporator is 15 mm to 35 mm.

Optionally, the cabinet includes a freezing liner located at the lowermost side, and the cooling chamber is defined in the freezing liner.

The storage compartment includes a freezing chamber defined by the freezing liner and located above the cooling chamber.

The centrifugal fan is configured to promote the cooled airflow to flow into the freezing chamber through the air supply duct.

In the refrigerator of the present invention, the cooling chamber is located at the lower part of the cabinet, so that the cooling chamber occupies a lower space in the cabinet, and the storage compartment is located above the cooling chamber, a compressor chamber may be defined at a lower rear side of the cooling chamber, and the storage compartment no longer needs to make room for the compressor chamber, thus guaranteeing the storage volume of the storage compartment. In addition, the air supply duct and the centrifugal fan adopt a split design, which implements modularization, is convenient for disassembly, assembly and transportation, and improves the yield rate.

Furthermore, in the refrigerator of the present invention, the duct front cover plate mates with the upper cover body of the volute to implement buckling assembly therebetween, and the duct rear cover plate mates with the lower box body of the volute to implement buckling assembly therebetween, and thus stability and airtightness of the assembly of the air supply duct and the volute are guaranteed while modularization is implemented.

The above, as well as other objectives, advantages, and characteristics of the present invention, will be better understood by those skilled in the art according to the following detailed description of specific embodiments of the present invention taken in conjunction with the accompanying drawings.

BRIEF DESCRIPTION OF THE DRAWINGS

In the following part, some specific embodiments of the present invention will be described in detail in an exemplary rather than limited manner with reference to the accompanying drawings. The same reference numerals in the accompanying drawings indicate the same or similar components or parts. Those skilled in the art should understand that these accompanying drawings are not necessarily drawn to scale. In the figures.

DETAILED DESCRIPTION OF THE INVENTION

The present embodiment provides a refrigerator 10, and the refrigerator 10 of embodiments of the present invention will be described below with reference to FIGS. 1-12. In the following description, orientations or positional relationships indicated by "front", "rear", "upper", "lower", "left", "right" and the like are orientations based on the refrigerator 10 itself as a reference, "front" and "rear" refer to directions indicated in FIGS. 5, 6, 11, and 12, and as shown in FIG. 1 and FIG. 4, "transverse" refers to a direction parallel to a width direction of the refrigerator 10.

Figure 1:
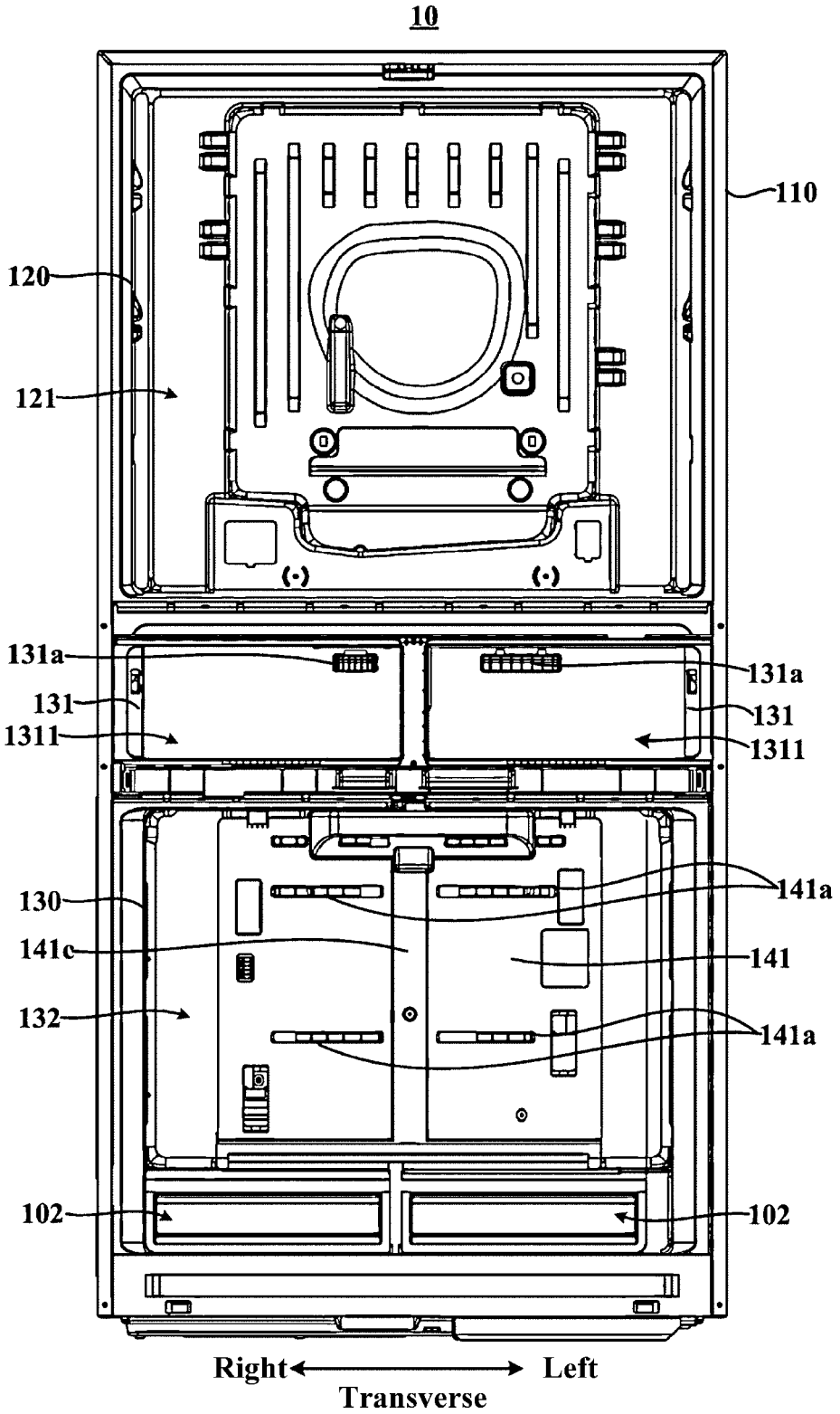
FIG. 1 is a front view of a refrigerator according to an embodiment of the present invention.
Figure 2:
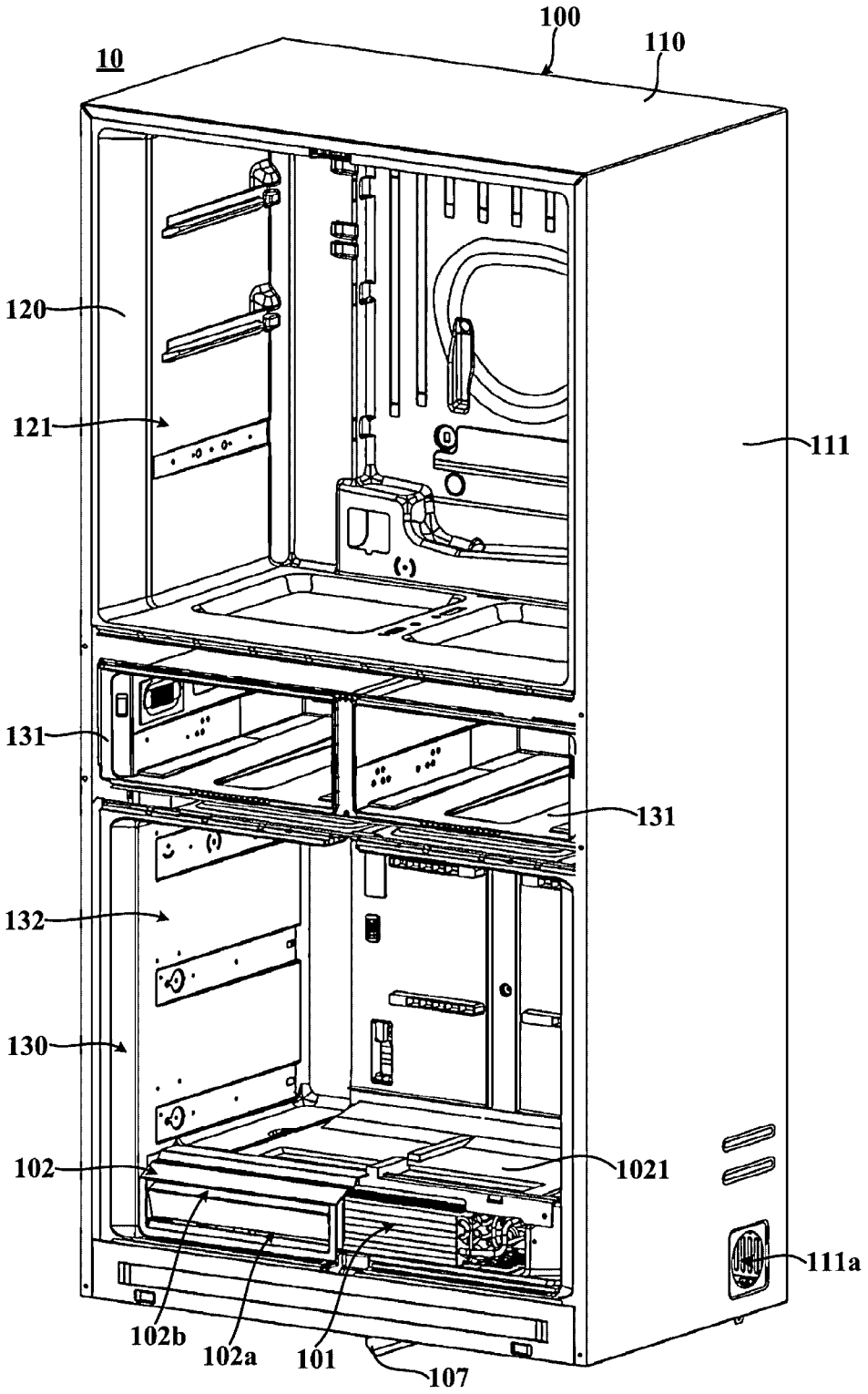
FIG. 2 is a schematic three-dimensional view of a refrigerator according to an embodiment of the present invention.

As shown in FIG. 1 and FIG. 2, the refrigerator 10 may generally include a cabinet 100; the cabinet 100 includes a housing 110 and a storage liner disposed inside the housing 110; a space between the housing 110 and the storage liner is filled with a thermal insulation material (forming a foamed layer); a storage compartment is defined in the storage liner; the storage liner may generally include a freezing liner 130, a refrigerating liner 120 and the like; and the storage compartment includes a freezing chamber 132 defined in the freezing liner 130 and a refrigerating chamber 121 defined in the refrigerating liner 120. A front side of the storage liner is further provided with a door, so as to open or close the storage compartment, and the door is hidden in both FIG. 1 and FIG. 2.

As can be appreciated by those skilled in the art, the refrigerator 10 of the present embodiment may further include an evaporator 101, an air supply fan (in the present embodiment, the air supply fan is a centrifugal fan 103), a compressor 104, a condenser 105, a throttle element (not shown) and the like. The evaporator 101 is connected with the compressor 104, the condenser 105, and the throttle element via a refrigerant pipeline to constitute a refrigeration cycle loop. The evaporator cools down when the compressor 104 is started, so as to cool air flowing therethrough.

In particular, in the present embodiment, a cooling chamber located at a lower part is defined in the cabinet 100, the storage compartment is located above the cooling chamber, and the evaporator 101 is disposed in the cooling chamber, so as to cool airflow entering the cooling chamber to form cooled airflow.

In a conventional refrigerator 10, the cooling chamber is generally located in a rear space of the cabinet 100, the freezing chamber 132 is generally located at the lowermost side of the cabinet, a compressor chamber is located behind the freezing chamber 132, and it is inevitable that the freezing chamber 132 should be made into a special-shaped space that makes room for the compressor chamber, so that the storage volume of the freezing chamber 132 is reduced, and problems in many aspects below are also brought. In one aspect, a position where the freezing chamber 132 is located is relatively low, and a user needs to bend over or squat down to pick and place items in the freezing chamber 132, which is inconvenient for the user in use, especially for the elderly. In another aspect, since a depth of the freezing chamber 132 is reduced, in order to guarantee the storage volume of the freezing chamber 132, it is necessary to increase the space in the height direction of the freezing chamber 132, and when storing items in the freezing chamber 132, the user needs to stack the items in the height direction, which is inconvenient for the user to find the items, and moreover, items located at a bottom of the freezing chamber 132 are prone to be blocked, so that it is difficult for the user to see the items to result in forgetting, which leads to deterioration and waste of the items. Furthermore, since the freezing chamber 132 is of the special-shaped space but not a rectangular space, it is inconvenient to place some items, which have relatively large sizes and are not easy to divide, in the freezing chamber 132.

However, in the present embodiment, the cooling chamber is located at the lower part of the cabinet 100, so that the cooling chamber occupies the lower space in the cabinet 100, and the storage compartment is located above the cooling chamber, the compressor chamber may be defined at a rear lower side of the cooling chamber, and the storage compartment no longer needs to make room for the compressor chamber, thus guaranteeing the storage volume of the storage compartment.

Specifically, the cooling chamber may be defined by the freezing liner 130. The freezing liner 130 is generally located at the lower part of the cabinet 100, and the cooling chamber and the freezing chamber 132 located above the cooling chamber are defined in the freezing liner 130. Thus, the freezing chamber 132 is raised, the bending-down degree of the user when the user takes and places the items in the freezing chamber 132 is reduced, and the use experience of the user is improved. Meanwhile, the freezing chamber 132 no longer needs to make room for the compressor chamber, so that the freezing chamber 132 is a rectangular space, and thus, the items can be changed from stacked storage to spread storage, which is convenient for the user to find the items, so that time and energy of the user are saved; meanwhile, it is also convenient to place items which have relatively large sizes and are not easy to divide, thereby solving the problem that relatively large items cannot be placed in the freezing chamber 132.

Generally, the refrigerator 10 further includes other storage liners located above the freezing liner 130, and the storage liners may be variable-temperature liners 131 or the refrigerating liner 120. In the present embodiment, the variable-temperature liners 131 are located above the freezing liner 130, and the refrigerating liner 120 is located above the variable-temperature liners 131. A variable-temperature chamber 1311 is defined in each variable-temperature liner 131, and as shown in FIG. 1 and FIG. 2, there are two temperature-variable liners 131, the two temperature-variable liners 131 are distributed in the transverse direction, and each variable-temperature liner 131 defines a variable-temperature chamber 1311.

As is well known by those skilled in the art, the temperature in the refrigerating chamber 121 is generally between 2° C. and 10° C., preferably between 4° C. and 7° C. The temperature in the freezing chamber 132 generally ranges from −22° C. to −14° C. The temperature of the variable-temperature chamber 1311 can be adjusted to −18° C. to 8° C. optionally. The optimal storage temperature for different types of items is different, and suitable storage locations are also different. For example, fruit and vegetable foods are suitable for being stored in the refrigerating chamber 121, while meat foods are suitable for being stored in the freezing chamber 132.

A refrigerating air duct (not shown) may be defined in the refrigerating liner 120, and a refrigerating evaporator (not shown) and a refrigerating fan (not shown) are disposed in the refrigerating air duct, so as to independently supply air to the refrigerating chamber 121.

Driven by the centrifugal fan 103, the cooled airflow is delivered into at least one storage compartment above the cooling chamber through the air supply duct 141. In the present embodiment, the cooled airflow is delivered to the freezing chamber 132 through the air supply duct 141. As shown in FIG. 1, the air supply duct 141 is located at an inner side of a rear wall of the freezing liner 130, and freezing chamber air inlets 141*a* communicating with the freezing chamber 132 are formed in the air supply duct 141, so as to deliver at least part of the cooled airflow into the freezing chamber 132. Generally, a recess recessed backwards and matching the air supply duct 141 is formed in the rear wall of the freezing liner 130, and the air supply duct 141 is embedded in the recess.

A rear side of a rear wall of each variable-temperature liner 131 may be provided with a variable-temperature chamber air duct (not shown), a variable-temperature chamber air inlet 131*a* communicating with an air outlet of the variable-temperature chamber air duct is formed in the rear wall of the variable-temperature liner 131, and the variable-temperature chamber air duct is configured to communicate with the air supply duct 141 in a controllable manner, so as to deliver part of the cooled airflow of the air supply duct 141 into the variable-temperature chamber 1311.

Figure 7:
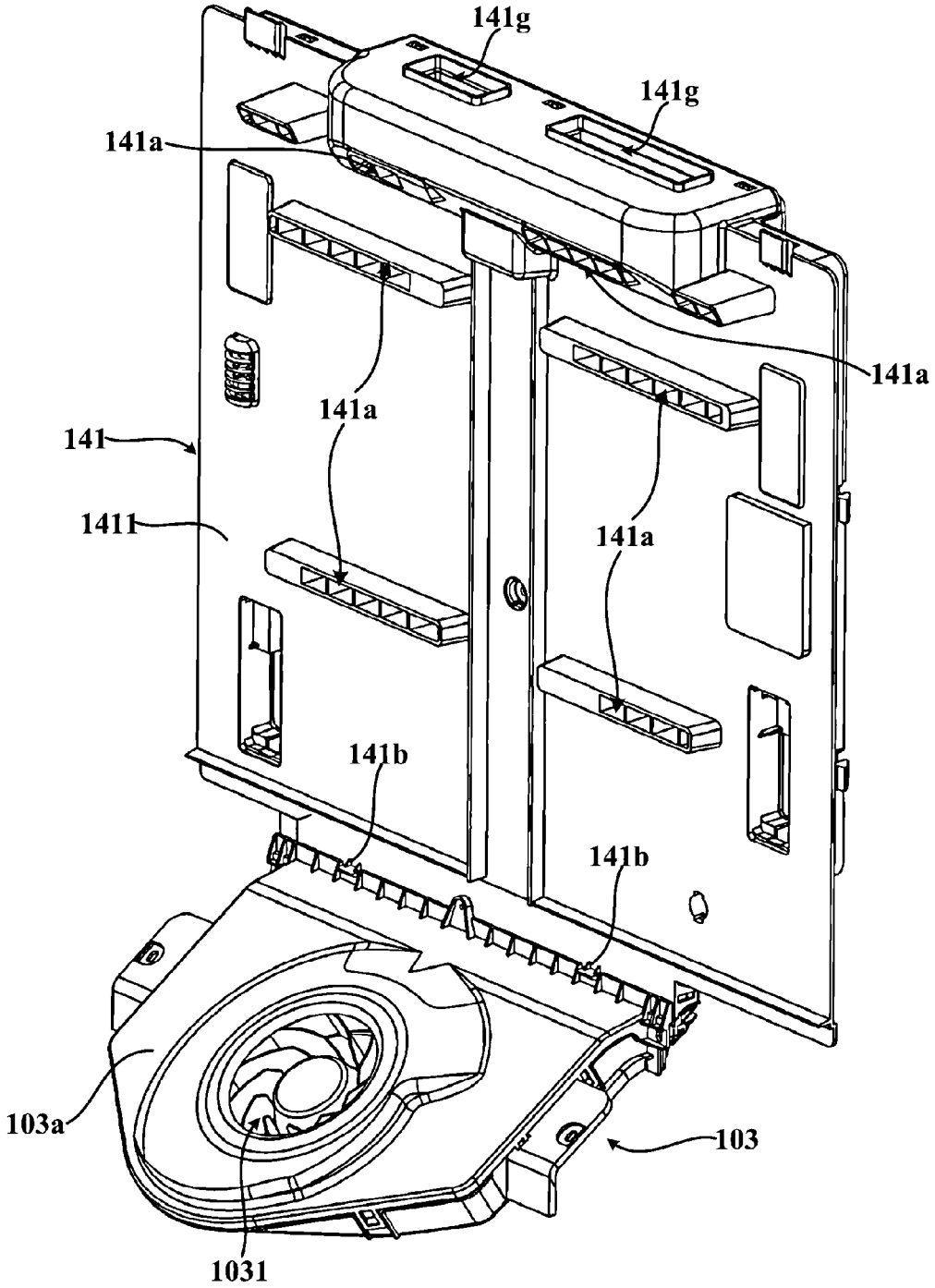
FIG. 7 is a schematic diagram of assembly of an air supply duct and a centrifugal fan of a refrigerator according to an embodiment of the present invention.

As shown in FIG. 7, at least one first top opening 141*g* is formed in a top end of the air supply duct 141, the first top opening 141*g* corresponds to air inlets of the variable-temperature chamber air ducts one-to-one, and at least one second top opening 130*d* corresponding to the at least one first top opening 141*g* one-to-one is formed in a top wall of the freezing liner 130, so as to communicate the first top opening 141*g* with the air inlets of the variable-temperature chamber air ducts through the second top opening 130*d*. A damper may be disposed at the first top opening 141*g* of the air supply duct 141, so as to open or close the first top opening 141*g* in a controlled manner As shown in FIG. 1, there are two temperature-variable liners 131, and correspondingly, there are two temperature-variable chamber air ducts, and there are two first top openings 141*g* as well as two second top openings 130*d*.

Figure 3:
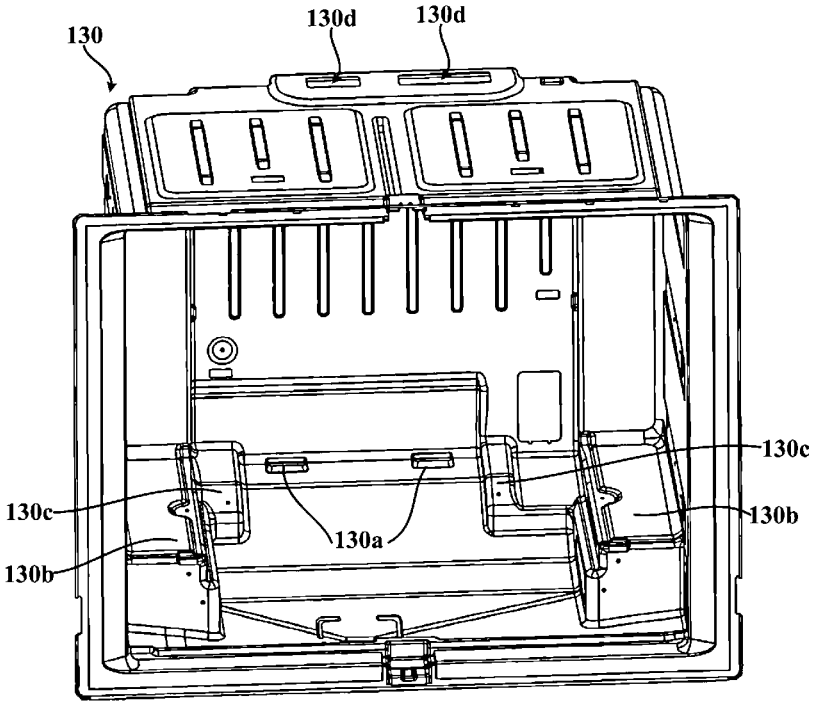
FIG. 3 is a schematic diagram of a freezing liner of a refrigerator according to an embodiment of the present invention.
Figure 4:
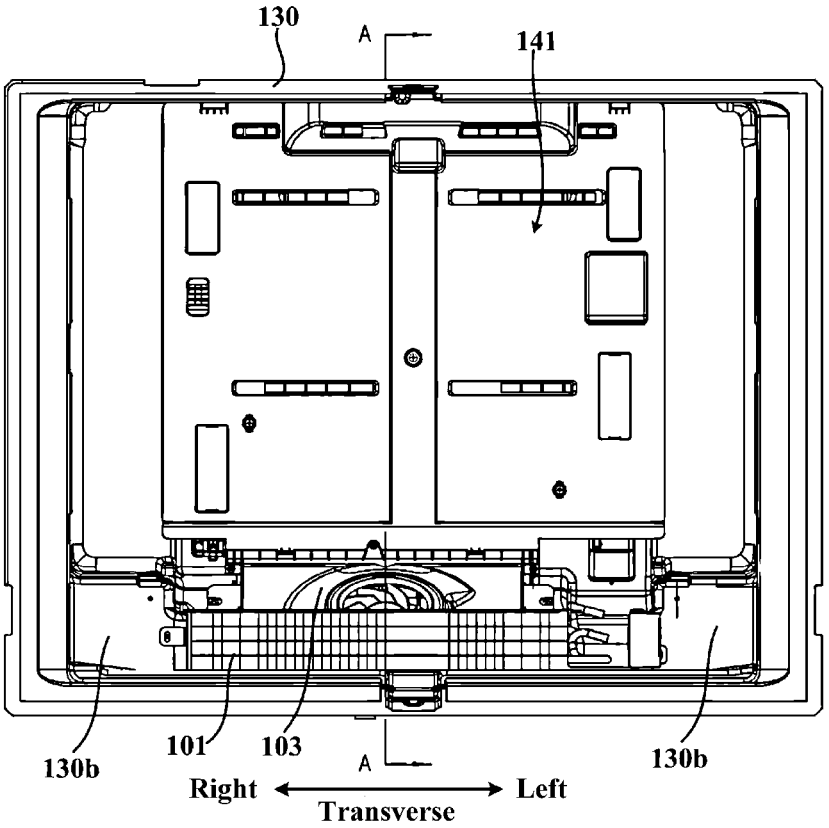
FIG. 4 is a front view of assembly of a freezing liner, an evaporator, a centrifugal fan, and an air supply duct of a refrigerator according to an embodiment of the present invention.
Figure 5:
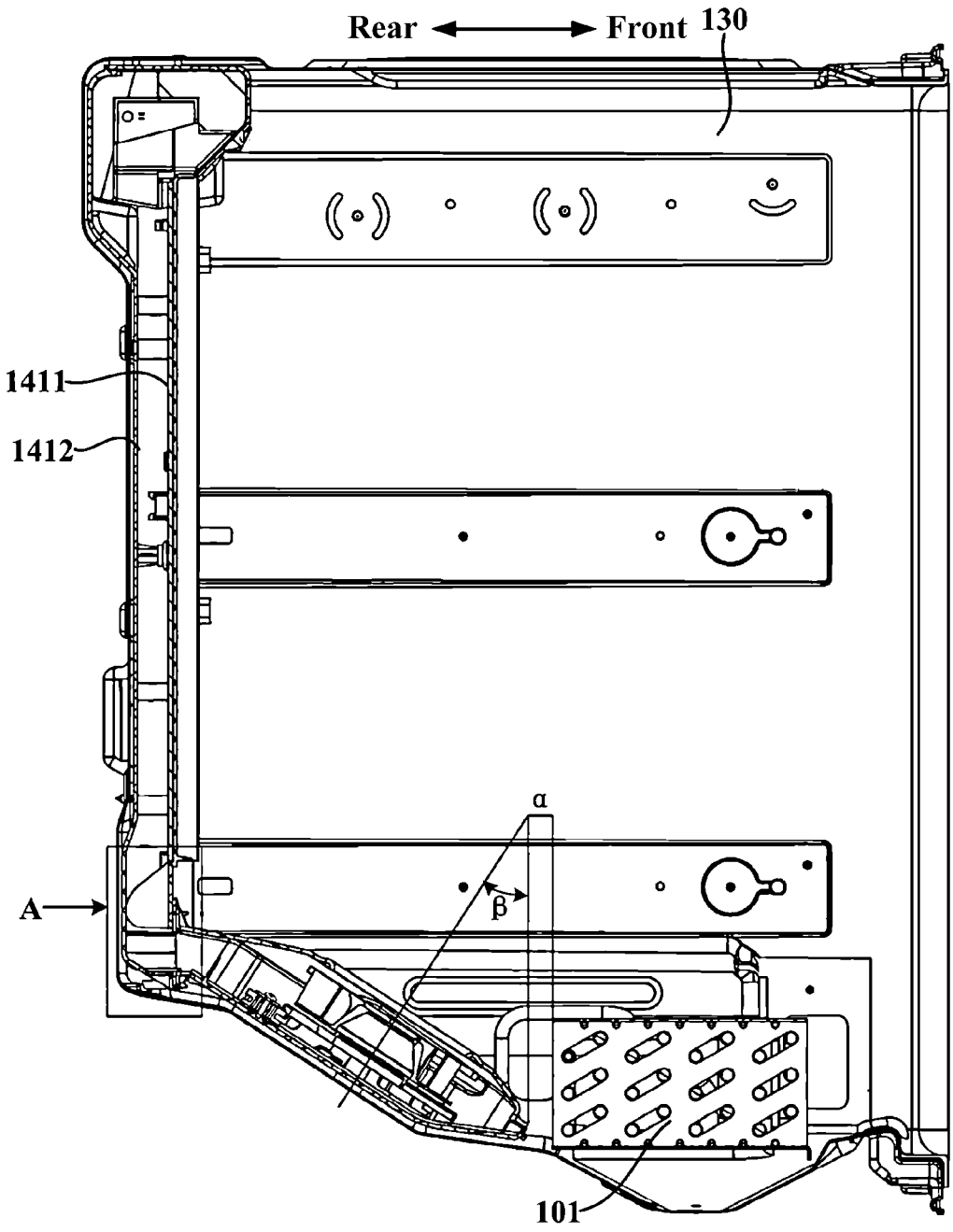
FIG. 5 is a cross-sectional view taken along the A-A direction of FIG. 4.

The freezing liner 130 and the cooling chamber are described in detail below:

As shown in FIG. 3 and FIG. 4, in some embodiments, regions of two transverse side walls of the freezing liner 130 corresponding to the cooling chamber protrude towards the cooling chamber respectively, so as to form a second limiting boss 130*b* respectively.

The refrigerator 10 further includes a shield plate, and the shield plate constitutes a top wall and a front wall of the cooling chamber, and defines the cooling chamber together with the two second limiting bosses 130*b*, sections of two side walls of the freezing liner 130 located in front of the corresponding second limiting bosses 130*b*, a bottom wall of the freezing liner 130 and the rear wall of the freezing liner 130.

The evaporator 101 can be transversely placed in the cooling chamber in a flat cube shape, that is, a length-width face of the evaporator 101 is parallel to the horizontal plane, a thickness face of the evaporator is placed in a manner of being perpendicular to the horizontal plane, and a thickness dimension of the evaporator 101 is obviously smaller than a length dimension thereof. By transversely placing the evaporator 101 in the cooling chamber, the evaporator 101 is prevented from occupying more space, so as to guarantee the storage volume of the freezing chamber 132 above the cooling chamber.

As shown in FIG. 2, the shield plate includes a top cover 1021 and at least one front cover group 102. The top cover 1021 is located above the evaporator 101. At least one front return air inlet is formed in a front side of each front cover group 102, so that return airflow of the freezing chamber 132 enters the cooling chamber through the at least one front return air inlet and is cooled by the evaporator 101, thereby forming an airflow circulation between the cooling chamber and the freezing chamber 132.

In some embodiments, as shown in FIG. 1, there are two front cover groups 102, the two front cover groups 102 are distributed in the transverse direction, and two front return air inlets are formed in the front side of each front cover group 102, which are a first front return air inlet 102*a* and a second front return air inlet 102*b*, respectively.

A side return air inlet (not shown) is formed in the side wall of the freezing liner 130, and the side return air inlet communicates with the variable-temperature liner 131 through a side return air passage (not shown), so as to deliver the return airflow of the variable-temperature chamber 1311 by using the side return air passage into the cooling chamber to be cooled, thereby forming an airflow circulation between the variable-temperature chamber 1311 and the cooling chamber.

Preferably, the side return air inlet is formed in the section of the side wall of the freezing liner 130 located in front of the corresponding second limiting boss 130*b*, so that the side return air inlet is located further forward, such that the return airflow of the variable-temperature chamber 1311 flows backwards from a front part of the evaporator 101, to extend a heat exchange path between the return airflow of the variable-temperature chamber 1311 and the evaporator 101, thus improving the heat exchange efficiency.

At least one first limiting boss 130*a* protruding upwards is formed in a rear section of the bottom wall of the freezing liner 130, and a limiting groove 130*a*1 is formed in each first limiting boss 130*a*; a mating portion 141*f* that mates with the limiting groove 130*a*1 is formed in a lower section of the air supply duct 141, and the mating portion 141*f* mates with the limiting groove 130*a*1, which can prevent the air supply duct 141 from moving downwards.

As shown in FIG. 3, there are two first limiting bosses 130*a*, and the two first limiting bosses 130*a* are spaced in the transverse direction; and correspondingly, there are two mating portions 141*f*, and the two mating portions 141*f* are spaced in the transverse direction.

Generally, it is inevitable that a spacing gap will be formed between the lower section of the air supply duct 141 located in the freezing liner 130 and the bottom wall of the freezing liner 130, and after the refrigerator 10 is assembled, under normal circumstances, the first top opening 141*g* in the top end of the air supply duct 141 should be in seal fit with the corresponding second top opening 130*d* in the top wall of the freezing liner 130.

During transportation of the refrigerator 10, when it is collided, the air supply duct 141 is prone to fall, so that there is a gap between the first top opening 141*g* in the top end of the air supply duct 141 and the corresponding second top opening 130*d* in the top wall of the freezing liner 130. During operation of the refrigerator 10, the airflow in the variable-temperature chamber 1311 can enter the freezing chamber 132 through the gap, and since airflow temperature of the variable-temperature chamber 1311 is generally higher than that of the freezing chamber 132, frost is formed near the top end of the air supply duct 141, which influences the temperature of the freezing chamber 132 and delivery of the cooled airflow. In the present embodiment, by the above special design of the bottom wall of the freezing liner 130 and the lower section of the air supply duct 141, it can be avoided that the air supply duct 141 falls due to collision during the transportation of the refrigerator 10, thus guaranteeing the refrigeration effect during the operation of the refrigerator 10.

A third limiting boss 130*c* protruding upwards is formed in each of positions on the two transverse sides of the bottom wall of the freezing liner 130 close to the rear end, and the two third limiting bosses 130*c* and a section of the bottom wall of the freezing liner 130 located behind the evaporator 101 define a space for arranging the centrifugal fan 103.

Figure 8:
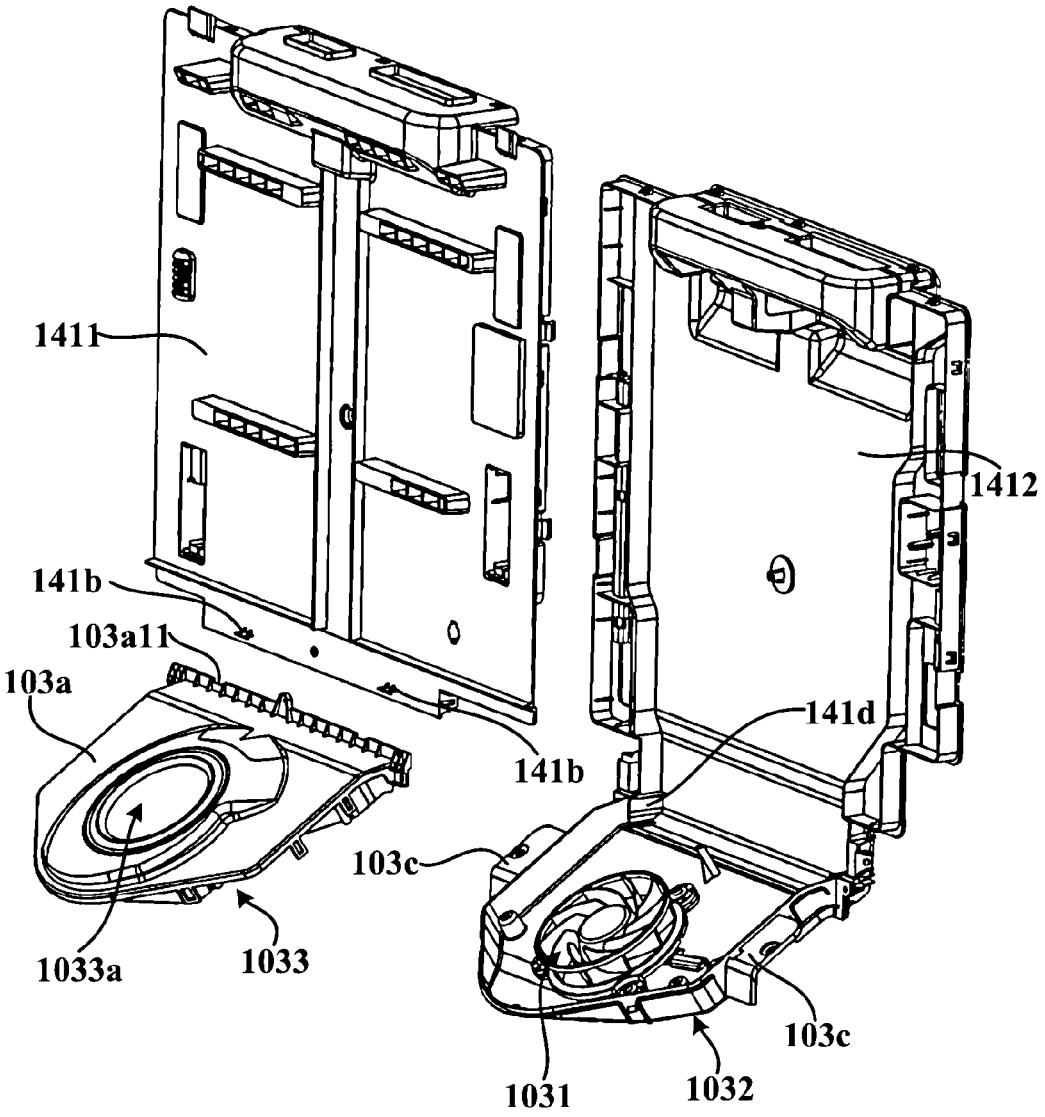
FIG. 8 is an exploded view of an air supply duct and a centrifugal fan of a refrigerator according to an embodiment of the present invention.
Figure 10:
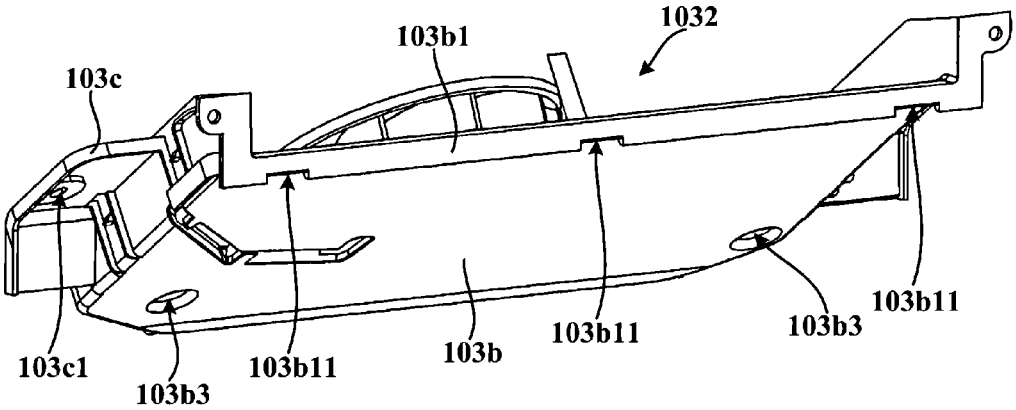
FIG. 10 is a schematic diagram of assembly of a lower box body of a volute and an impeller of a centrifugal fan of a refrigerator according to an embodiment of the present invention.

A first mounting hole (not labeled) may be formed in each third limiting boss 130*c*. Second mounting holes 103*c*1 that correspond to the two first mounting holes one-to-one are formed in the volute of the centrifugal fan 103, so as to mount the volute of the centrifugal fan 103 on the bottom wall of the freezing liner 130 by mounting members (for example, screws) that pass through the second mounting holes 103*c*1 and the first mounting holes sequentially. For example, as shown in FIG. 8 and FIG. 10, a mounting plate 103*c* is formed on each of the two transverse sides of the side wall of the lower box body 1032, and the second mounting holes 103*c*1 that correspond to the first mounting holes are formed in the mounting plates 103*c*.

The centrifugal fan 103 and the air supply duct 141 are described in detail below:

The centrifugal fan 103 is located behind the evaporator 101 and includes a volute and an impeller 1031 disposed in the volute; the air supply duct 141 is detachably connected with the volute; and a duct air inlet of the air supply duct is made to communicate with a volute air outlet of the volute, so that the airflow in the volute enters the air supply duct 141.

In an existing refrigerator 10, an air duct and a volute of a fan are mostly of an integrated structure, which is inconvenient for transportation, and modularization cannot be performed. In the present embodiment, the air supply duct 141 and the volute of the centrifugal fan 103 adopt a split design, which implements modularization, is convenient for disassembly, assembly and transportation, and improves the yield rate.

The volute includes a lower box body 1032 and an upper cover body 1033 disposed on the lower box body 1032, and the lower box body 1032 can be connected with the upper cover body 1033 in a buckling manner, which is convenient for disassembly and assembly of the volute. A rear end and a lower part of the upper cover body 1033 are both opened, that is, the upper cover body 1033 includes a top wall 103*a* and a first side wall 103*d* extending downwards from the top wall 103*a*; correspondingly, a rear end and an upper part of the lower box body 1032 are both opened, and the lower box body 1032 includes a bottom wall 103*b* and a second side wall extending upwards from the bottom wall 103*b*. A volute air inlet 1033*a* is formed in the top wall 103*a* of the upper cover body 1033, and the rear end of the upper cover body 1033 and the rear end of the lower box body 1032 define a volute air outlet.

After the upper cover body 1033 and the lower box body 1032 are buckled, the first side wall 103*d* of the upper cover body 1033 is located at an inner side of the second side wall of the lower box body 1032, that is, the first side wall 103*d* of the upper cover body 1033 defines the air supply duct in the volute together with the top wall 103*a* of the upper cover body 1033 and the bottom wall 103*b* of the lower box body 1032.

Figure 9:
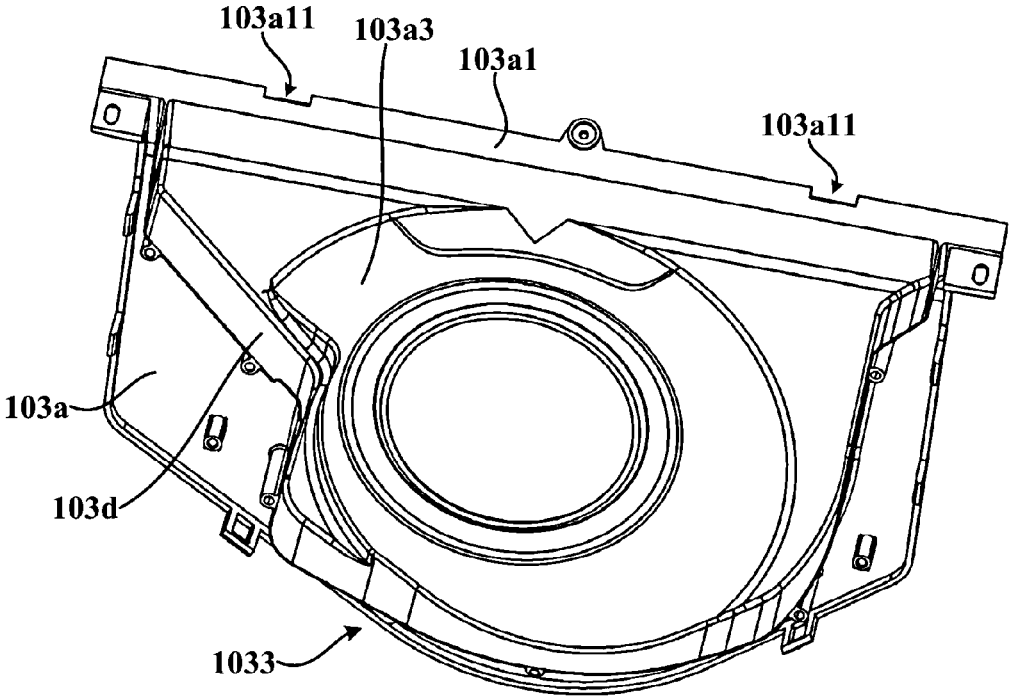
FIG. 9 is a schematic diagram of an upper cover body of a volute of a centrifugal fan of a refrigerator according to an embodiment of the present invention.

Referring to FIG. 9, the first side wall 103*d* of the upper cover body 1033 has a scroll line which is configured as a volute air duct to better guide the airflow to flow to the volute air outlet, so as to reduce noise. A scroll groove 103*a*3 is formed in an inner face of the top wall 103*a* of the upper cover body 1033, and the scroll groove 103*a*3 mates with the first side wall 103*d* of the upper cover body 1033 to better guide the airflow to flow. For example, the scroll groove 103*a*3 is formed in an inner face of a seventh inclined straight section of the top wall 103*a* of the upper cover body 1033. The volute air inlet 1033*a* is formed in the scroll groove 103*a*3, and the impeller 1031 is disposed in a region defined by the scroll groove 103*a*3 and the lower box body 1032.

An included angle β between a rotation axis of the impeller 1031 and a vertical line may be 20° to 35°, for example, β is 20°, 25°, 33°, 35°, etc.

A horizontal distance a between a front end face of the volute of the centrifugal fan 103 and a rear end face of the evaporator 101 can be 15 mm to 35 mm, for example, a is 15 mm, 20 mm, 25 mm, 30 mm, or 35 mm, thus avoiding that the centrifugal fan 103 frosts due to the fact that the distance between the centrifugal fan 103 and the evaporator 101 is too small.

At least one drain hole 103*b*3 may be formed in the bottom wall 103*b* of the lower box body 1032, and as shown in FIG. 10, there are two drain holes 103*b*3, so as to facilitate discharge of condensate water that may be formed.

The air supply duct 141 is located behind the centrifugal fan 103 and includes a duct front cover plate 1411 located at a front side and a duct rear cover plate 1412 located at a rear side, and the duct front cover plate 1411 and the duct rear cover plate 1412 can be assembled in a buckling manner. The duct front cover plate 1411 and the upper cover body 1033 are detachably connected, and the duct rear cover plate 1412 and the lower box body 1032 are detachably connected, so that the volute air outlet communicates with the duct air inlet of the air supply duct 141.

Figure 6:
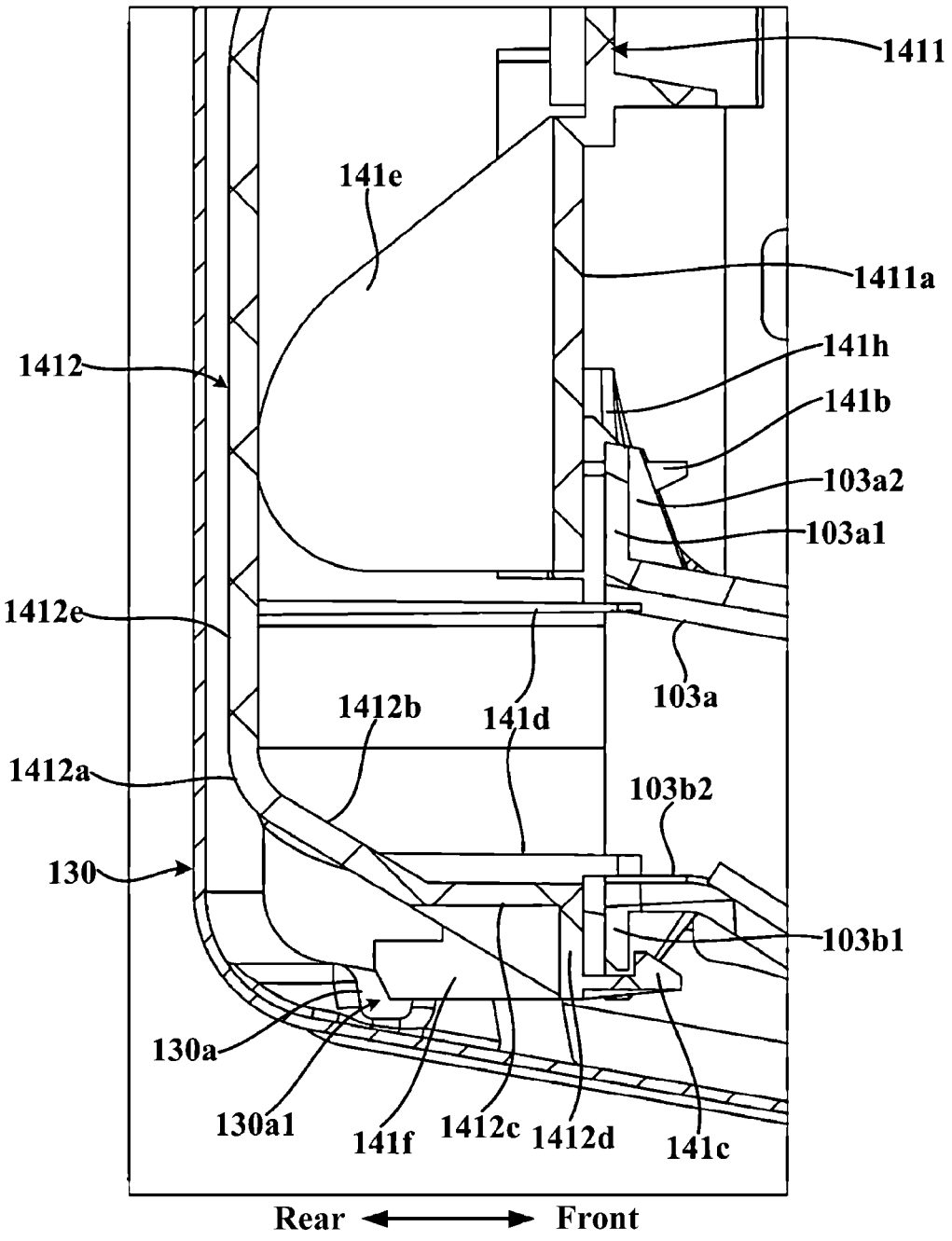
FIG. 6 is an enlarged view of a region A in FIG. 5.

As shown in FIG. 6, the duct rear cover plate 1412 may include a rear vertical plate section 1412*e* located at a lower part and vertically extending and a joint section bent and extending forwards and downwards from a lower end of the rear vertical plate section 1412*e*, the joint section is located below the duct front cover plate 1411, and a front end of the joint section and a lower end of the duct front cover plate 1411 define the duct air inlet. The duct rear cover plate 1412 is detachably connected with the lower box body 1032 through the joint section, and the mating portion 141*f* is formed on the joint section.

In the present embodiment, the duct rear cover plate 1412 is designed to have the joint section bent and extending forwards and downwards from the lower end of the rear vertical plate section 1412*e*, which is convenient for the duct rear cover plate to be connected with the volute of the centrifugal fan 103 in front, and promotes the airflow in the volute to gently enter the air supply duct 141 to reduce noise. Meanwhile, the mating portion 141*f* mating with the limiting groove 130*a*1 of the bottom wall of the freezing liner 130 is formed in the joint section, so that the duct rear cover plate 1412 can actively mate with the freezing liner 130 and the volute of the centrifugal fan 103, and the overall layout is more compact and reasonable.

As shown in FIG. 6, the joint section of the duct rear cover plate 1412 includes a transitional curved section 1412*a* curved and extending forwards and downwards from the rear vertical plate section 1412*e*, a first inclined straight section 1412*b* obliquely extending forwards and downwards from the transitional curved section 1412*a* and a horizontal straight section 1412*c* extending forwards in a front-rear direction from the first inclined straight section 1412*b*.

A first vertical plate 1412*d* vertically extending downwards is formed at a front end of the horizontal straight section 1412*c*, the first vertical plate 1412*d* extends from one transverse side of the horizontal straight section 1412*c* to the other side, at least one first buckle 141*c* protruding forwards is formed on a front vertical face of the first vertical plate 1412*d*, and the mating portion 141*f* protruding backwards may be formed on a rear vertical face of the first vertical plate 1412*d*.

A second vertical plate 103*b*1 vertically extending downwards is formed at a rear end of the bottom wall 103*b* of the lower box body 1032, the second vertical plate 103*b*1 extends from one transverse side of the bottom wall 103*b* of the lower box body 1032 to the other side, first notches 103*b*11 corresponding to and fitting with the at least one first buckle 141*c* one-to-one are formed in a lower end of the second vertical plate 103*b*1, and the first buckle 141*c* is buckled into the corresponding first notch 103*b*11 and is hooked with a front vertical face of the second vertical plate 103*b*1, so as to make the lower box body 1032 be buckled on the duct rear cover plate 1412.

There are two first buckles 141*c*, and the three first buckles 141*c* are spaced in the transverse direction; correspondingly, there are three first notches 103*b*11, and the three first notches 103*b*11 are spaced in the transverse direction.

When the lower box body 1032 and the duct rear cover plate 1412 are buckled, the front vertical face of the first vertical plate 1412*d* closely abuts on a rear vertical face of the second vertical plate 103*b*1, and there is a small spacing gap therebetween; a sponge bar can be inserted into the spacing gap to avoid air leakage.

As shown in FIG. 6, the duct front cover plate 1411 includes a front vertical plate section 1411*a* located at the lower part and vertically extending, and at least one second buckle 141*b* protruding forwards is formed on a front wall surface of the front vertical plate section 1411*a*.

A third vertical plate 103*a*1 extending upwards is formed at the rear end of the top wall 103*a* of the upper cover body 1033, the third vertical plate 103*a*1 extends from one transverse side of the top wall 103*a* of the upper cover body 1033 to the other side, at least one second notch 103*a*11 corresponding to and fitting with the at least one second buckle 141*b* one-to-one is formed at an upper end of the third vertical plate 103*a*1, and the second buckle 141*b* is buckled into the corresponding second notch 103*a*11 and is hooked with a front vertical face of the third vertical plate 103*a*1, so as to make the upper cover body 1033 be buckled on the duct front cover plate 1411.

There are two second buckles 141*b*, and the two second buckles 141*b* are spaced in the transverse direction; correspondingly, there are two second notches 103*a*11, and the two second notches 103*a*11 are spaced in the transverse direction.

A transverse dimension of the front vertical plate section 1411*a* should be equal to or greater than that of the third vertical plate 103*a*1. As shown in FIG. 8, the transverse dimension of the front vertical plate section 1411*a* is approximately equal to that of the third vertical plate 103*a*1, so that when the upper cover body 1033 and the duct front cover plate 1411 are buckled, the front vertical plate section 1411*a* can completely cover the third vertical plate 103*a*1. When the upper cover body 1033 and the duct front cover plate 1411 are buckled, a rear vertical face of the front vertical plate section 1411*a* closely abuts on the front vertical face of the third vertical plate 103*a*1, and there is a small spacing gap therebetween; a sponge bar can be inserted into the spacing gap to avoid air leakage.

A plurality of reinforcement ribs 141*e* protruding backwards may be formed on a rear wall of the front vertical plate section 1411*a* to enhance the strength of the front vertical plate section 1411*a*.

A plurality of reinforcement ribs 103*a*2 spaced in the transverse direction are formed on the front vertical face of the third vertical plate 103*a*1, and a mounting portion 141*h* protruding from an upper part of the third vertical plate 103*a*1 is further formed on the third vertical plate 103*a*1. For example, the mounting portion 141*h* is formed in a transverse middle position of the third vertical plate 103*a*1, first screw holes are formed in the mounting portion 141*h*, and second screw holes corresponding to the first screw holes are formed in a region of the front vertical plate section 1411*a* corresponding to the mounting portion 141*h*, so as to assemble the upper cover body 1033 with the duct front cover plate 1411 by using screws passing through the first screw holes and the second screw holes.

A sealing portion 141*d* extending forwards is formed at each of two transverse sides of the duct rear cover plate 1412.

As shown in FIG. 6 and FIG. 8, a section defined by the rear vertical plate section 1412*e* and the joint section of the duct rear cover plate 1412 is marked as a lower plate section of the duct rear cover plate 1412; a sealing portion 141*d* extending forwards is formed on an inner side of each of two transverse ends of the lower plate section, and each sealing portion 141*d* extends into the volute of the centrifugal fan 103, to seal two transverse sides of a junction of the air supply duct 141 and the volute of the centrifugal fan 103, that is, to seal a junction of the two transverse sides when the duct rear cover plate 1412 and the lower box body 1032 are buckled, and to seal a junction of the two transverse sides when the duct front cover plate1411 and the upper cover body 1033 are buckled, so as to avoid air leakage. That is, the two transverse sides of the junction of the duct air inlet and the volute air outlet are sealed.

In the refrigerator 10 of the present embodiment, the compressor chamber is defined at the bottom of the cabinet 100, and the compressor chamber is located at the rear lower side of the cooling chamber. As previously, the freezing chamber 132 no longer needs to make room for the compressor chamber, which guarantees the depth of the freezing chamber 132, and is convenient to place items which have relatively large sizes and are not easy to divide.

Figure 11:
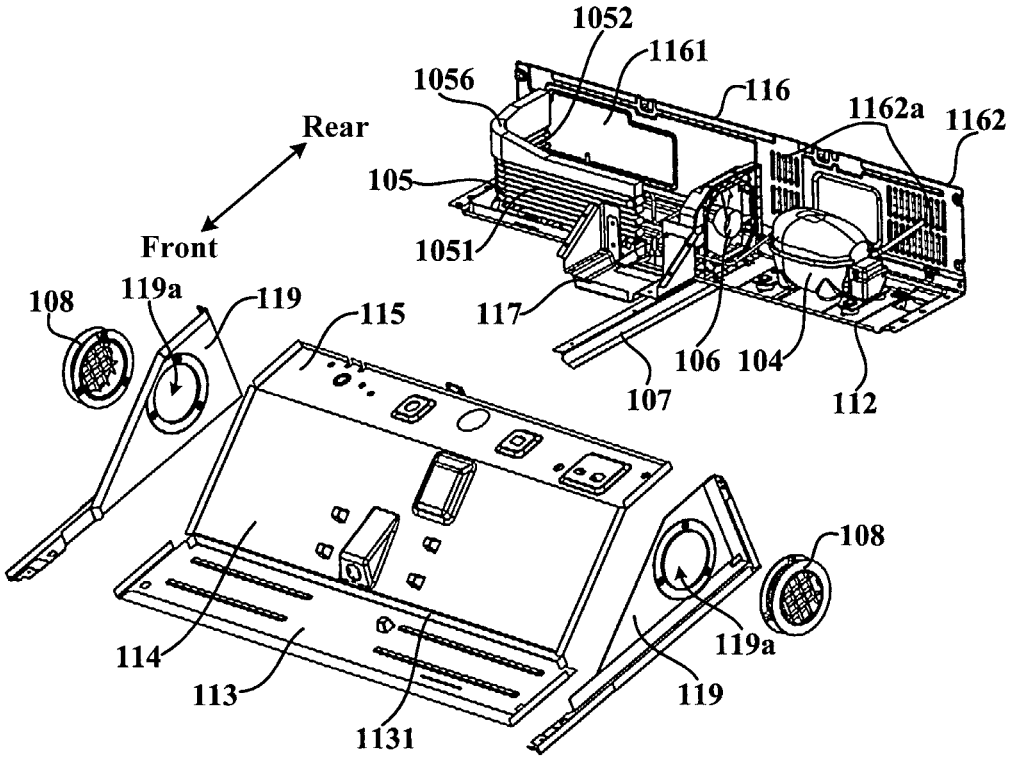
FIG. 11 is a partial exploded view of a refrigerator according to an embodiment of the present invention.

As shown in FIG. 11, the refrigerator 10 further includes a heat dissipation fan 106; the heat dissipation fan 106 can be an axial flow fan; and the compressor 104, the heat dissipation fan 106 and the condenser 105 are successively disposed in the compressor chamber at intervals in the transverse direction.

In some embodiments, at least one rear air outlet 1162*a* is formed in a section 1162 of a rear wall of the compressor chamber corresponding to the compressor 104.

In fact, prior to the present invention, usual design ideas of those skilled in the art are to provide rear air inlets facing the condenser 105 and rear air outlets 1162*a* facing the compressor 104 in the rear wall of the compressor chamber to complete the circulation of the heat dissipation airflow at the rear part of the compressor chamber; or to form ventilation holes in each of a front wall and the rear wall of the compressor chamber to form a heat dissipation air circulation path in the front-rear direction. When facing the problem of improving the heat dissipation effect of the compressor chamber, those skilled in the art generally increase the number of rear air inlets and rear air outlets 1162*a* in the rear wall of the compressor chamber to increase the ventilation area, or increase the heat exchange area of the condenser 105, for example, using a U-shaped condenser with a larger heat exchange area.

Figure 12:
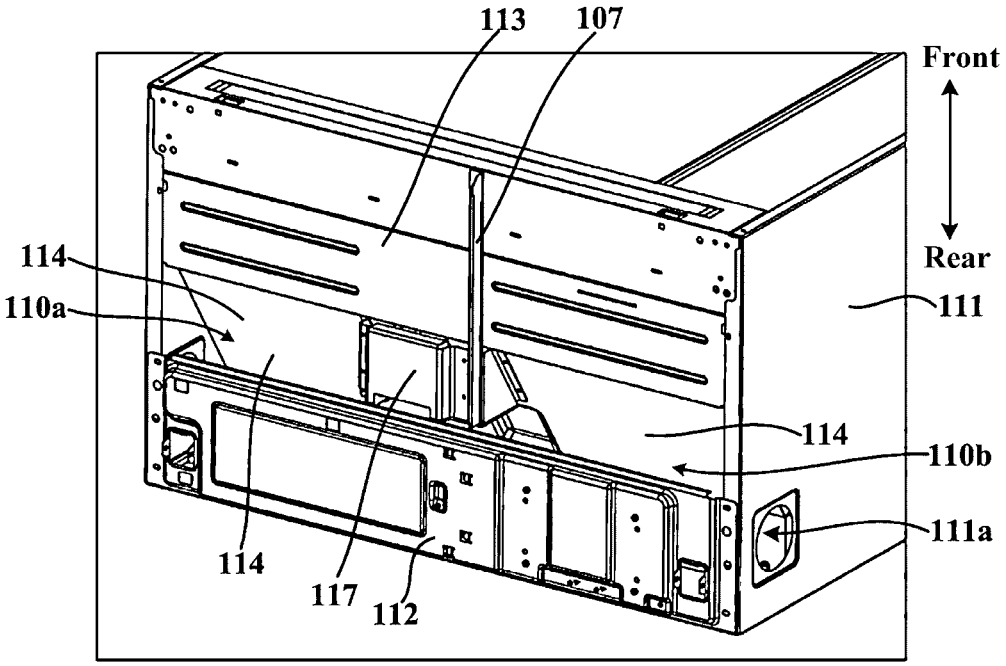
FIG. 12 is a partial schematic diagram of a refrigerator according to an embodiment of the present invention.

The applicants of the present invention creatively recognized that the heat exchange area of the condenser 105 and the ventilation area of the compressor chamber are not the larger the better, and in a conventional design scheme of increasing the heat exchange area of the condenser 105 and the ventilation area of the compressor chamber, the problem of non-uniform heat dissipation of the condenser 105 is caused, and adverse effects are generated on a refrigerating system of the refrigerator 10. For this, the applicants of the present invention jump out of the conventional design idea and creatively put forward a new solution different from the conventional design. As shown in FIG. 11 and FIG. 12, a bottom air inlet 110*a* close to the condenser 105 and a bottom air outlet 110*b* close to the compressor 104, which are arranged transversely, are defined on the bottom wall of the cabinet to complete the circulation of the heat dissipation airflow at the bottom of the refrigerator 10; the space between the refrigerator 10 and a supporting surface is fully used, without increasing the distance between the rear wall of the refrigerator 10 and a cupboard, thus guaranteeing good heat dissipation of the compressor chamber while reducing the space occupied by the refrigerator 10, which fundamentally solves the problem that heat dissipation of the compressor chamber and space occupation of the embedded refrigerator 10 cannot be balanced, and is of great significance.

The heat dissipation fan 106 is configured to promote the ambient air around the bottom air inlet 110*a* to enter the compressor chamber from the bottom air inlet 110*a*, to pass through the condenser 105 and the compressor 104 sequentially, and then to flow from the bottom air outlet 110*b* to the external environment, so as to dissipate heat from the compressor 104 and the condenser 105.

In a vapor compression refrigeration cycle, the surface temperature of the condenser 105 is generally lower than that of the compressor 104, so the external air is made to cool the condenser 105 first and then cool the compressor 104 in the process above.

Furthermore particularly, in a preferred embodiment of the present invention, a plate section 1161 of a back plate 116 (the rear wall of the compressor chamber) facing the condenser 105 is a continuous plate surface, that is, there is no heat dissipation hole in the plate section 1161 of the back plate 116 facing the condenser 105.

The applicants of the present invention creatively recognized that even if the ventilation area of the compressor chamber is abnormally reduced without increasing the heat exchange area of the condenser 105, a better heat dissipation airflow path can be formed, and a better heat dissipation effect can still be achieved.

In a preferred solution of the present invention, the applicants break through the conventional design ideas and design the plate section 1161 of the rear wall (the back plate 116) of the compressor chamber corresponding to the condenser 105 as the continuous plate surface to seal the heat dissipation airflow entering the compressor chamber at the condenser 105, so that the ambient air entering from the bottom air inlet 110*a* is concentrated more at the condenser 105, which guarantees heat exchange uniformity of all condensation sections of the condenser 105, and helps to form a better heat dissipation airflow path, and thus a better heat dissipation effect can be achieved as well.

Moreover, the plate section 1161 of the back plate 116 facing the condenser 105 is the continuous plate surface and is not provided with the air inlet, so that it is avoided that in the conventional design, air outlet and air inlet are both concentrated at the rear part of the compressor chamber, which causes that the hot air blown from the compressor chamber enters the compressor chamber again without being cooled by the ambient air in time, leading to adverse effects on heat exchange of the condenser 105, and thus the heat exchange efficiency of the condenser 105 is guaranteed.

In some embodiments, a side ventilation hole 119*a* is formed in each of two transverse side walls of the compressor chamber, the side ventilation hole 119*a* may be covered with a ventilation cover plate 108, and grille-type small ventilation holes are formed in the ventilation cover plate 108. The housing of the refrigerator 10 includes two cabinet side plates 111 in the transverse direction, the two cabinet side plates 111 vertically extend to constitute two side walls of the refrigerator 10, and a side opening 111*a* communicating with the corresponding side ventilation hole 119*a* is formed in each of the two cabinet side plates 111, so that the heat dissipation airflow flows to the outside of the refrigerator 10. Thus, a heat dissipation path is further extended, thereby guaranteeing the heat dissipation effect of the compressor chamber.

Furthermore particularly, the condenser 105 includes a first straight section 1051 extending in the transverse direction, a second straight section 1052 extending in the front-rear direction, and a transition bent section (not labeled) connecting the first straight section 1051 and the second straight section 1052, thereby forming an L-shaped condenser 105 with an appropriate heat exchange area. The plate section 1161 of the rear wall (the back plate 116) of the compressor chamber corresponding to the condenser 105 is the plate section 1161 of the back plate 116 facing the first straight section 1051.

The ambient airflow entering from the side ventilation holes 119*a* directly exchanges heat with the second straight section 1052, and the ambient air entering from the bottom air inlet 110*a* directly exchanges heat with the first straight section 1051, thus further concentrating the ambient air entering the compressor chamber more at the condenser 105 to guarantee uniformity of overall heat dissipation of the condenser 105.

Furthermore particularly, the housing of the cabinet 100 includes a bottom plate, a supporting plate 112, two side plates 119 and the back plate 116 extending vertically; the supporting plate 112 forms the bottom wall of the compressor chamber, and is used to bear the compressor 104, the heat dissipation fan 106 and the condenser 105, the two side plates form two transverse side walls of the compressor chamber, respectively, and the vertically extending back plate 116 forms the rear wall of the compressor chamber.

Furthermore particularly, the bottom plate includes a bottom horizontal section 113 located at the front side of the bottom and a bent section bent and extending backwards and upwards from a rear end of the bottom horizontal section 113, the bent section extends to an upper side of the supporting plate 112, and the compressor 104, the heat dissipation fan 106 and the condenser 105 are successively disposed on the supporting plate 112 at intervals in the transverse direction, and are located in a space defined by the supporting plate 112, the two side plates, the back plate 116 and the bent section.

The supporting plate 112 and the bottom horizontal section 113 jointly constitute the bottom wall of the cabinet 100, and the supporting plate 112 and the bottom horizontal section 113 are spaced, so as to define a bottom opening by using the rear end of the bottom horizontal section 113 and a front end of the supporting plate 112. The bent section has an inclined section 114 located above the bottom air inlet 110*a* and the bottom air outlet 110*b*. The two side plates extend upwards from two transverse sides of the supporting plate 112 to two transverse sides of the bent section respectively, so as to seal the two transverse sides of the compressor chamber; and the back plate 116 extends upwards from a rear end of the supporting plate 112 to a rear end of the bent section.

Specifically, the bent section may include a vertical section 1131, the aforementioned inclined section 114 and a top horizontal section 115. The vertical section 1131 extends upwards from the rear end of the bottom horizontal section 113. The inclined section 114 extends upwards and backwards from an upper end of the vertical section 1131 to the upper side of the supporting plate 112. The top horizontal section 115 extends backwards from a rear end of the inclined section 114 to the back plate, so as to cover the upper sides of the compressor 104, the heat dissipation fan 106 and the condenser 105.

The cabinet 100 further includes a divider 117, and the divider 117 is disposed behind the bent section. A front part of the divider is connected with the rear end of the bottom horizontal section 113, and a rear part of the divider is connected with the front end of the supporting plate 112. The divider is configured to divide the bottom opening into the bottom air inlet 110*a* and the bottom air outlet 110*b* which are distributed in the transverse direction.

It can be known from the foregoing that the bottom air inlet 110*a* and the bottom air outlet 110*b* of the present embodiment are defined by the divider 117, the supporting plate 112 and the bottom horizontal section 113, so that the groove-shaped bottom air inlet 110*a* and the groove-shaped bottom air outlet 110*b* with large opening sizes are formed, the air inlet area and the air outlet area are increased, the air inlet resistance is reduced, making the circulation of airflow smoother, the manufacturing process is simpler, and the integral stability of the compressor chamber is stronger.

In particular, the applicants of the present invention creatively realized that a slope structure of the inclined section 114 is capable of guiding and rectifying inlet airflow, so that the airflow entering from the bottom air inlet 110*a* flows more concentratedly to the condenser 105, avoiding that the airflow is too dispersed to pass more through the condenser 105, thereby further ensuring the heat dissipation effect of the condenser 105. Meanwhile, the slope of the inclined section 114 guides outlet airflow from the bottom air outlet 110*b* to the front side of the bottom air outlet, so that the outlet airflow flows out of the compressor chamber more smoothly, and thus the smoothness of airflow circulation is further improved.

Furthermore particularly, in a preferred embodiment, the inclined section 114 has an included angle of less than 45° with the horizontal plane, and in such embodiment, the inclined section 114 is better in airflow guiding and rectifying effect.

Moreover, it is unexpected that the applicants of the present application creatively recognized that the slope of the inclined section 114 provides a better dampening effect on airflow noise, and in prototype tests, noise of the compressor chamber with the aforementioned specially designed inclined section 114 can be reduced by 0.65 decibels or above.

In addition, in the conventional refrigerator 10, the bottom of the cabinet 100 is generally provided with a bearing plate with a roughly flat plate structure, the compressor 104 is disposed at an inner side of the bearing plate, and vibration generated during the operation of the compressor 104 has a great impact on the bottom of the cabinet 100. However, in the present embodiment, as previously described, the bottom of the cabinet 100 is constructed as a three-dimensional structure by the bottom plate and supporting plate 112 of a special structure to provide an independent three-dimensional space for arrangement of the compressor 104, and the compressor 104 is borne by using the supporting plate 112 to reduce the impact of the vibration of the compressor 104 on other components at the bottom of the cabinet 100. In addition, by designing the cabinet 100 to be the ingenious special structure, the bottom of the refrigerator 10 is compact in structure and reasonable in layout, the overall size of the refrigerator 10 is reduced, and the space at the bottom of the refrigerator 10 is fully used, thereby guaranteeing the heat dissipation efficiency of the compressor 104 and the condenser 105.

Furthermore particularly, a wind blocking piece 1056 is arranged at an upper end of the condenser 105. The wind blocking piece 1056 may be wind blocking sponge for filling a space between the upper end of the condenser 105 and the bent section. That is, the wind blocking piece 1056 covers upper ends of the first straight section 1051, the second straight section 1052 and the transition bent section, and an upper end of the wind blocking piece 1056 should abut against the bent section to seal the upper end of the condenser 105, so that the situation that part of the air entering the compressor chamber passes through the space between the upper end of the condenser 105 and the bent section and does not pass through the condenser 105 is avoided, thus the air entering the compressor chamber is subjected to heat exchange through the condenser 105 as much as possible, and the heat dissipation effect of the condenser 105 is further improved.

The refrigerator 10 further includes a wind blocking strip 107 extending forwards and backwards; the wind blocking strip 107 is located between the bottom air inlet and the bottom air outlet, extends from a lower surface of the bottom horizontal section 113 to a lower surface of the supporting plate 112, and is connected with a lower end of the divider, so as to completely isolate the bottom air inlet from the bottom air outlet by using the wind blocking strip 107 and the divider, and thus, when the refrigerator 10 is placed on a supporting surface, a space between the bottom wall of the cabinet 100 and the supporting surface is transversely divided to allow external air to enter the compressor chamber under the action of the heat dissipation fan 106 through the bottom air inlet located at one transverse side of the wind blocking strip 107, to flow through the condenser 105 and the compressor 104 sequentially, and to finally flow out from the bottom air outlet located at the other transverse side of the wind blocking strip 107, thereby completely isolating the bottom air inlet from the bottom air outlet, which guarantees that the external air entering the condenser 105 and the heat dissipation air discharged from the compressor 104 will not be crossed, to further guarantee the heat dissipation efficiency.

Hereto, those skilled in the art should realize that although multiple exemplary embodiments of the present invention have been shown and described in detail herein, without departing from the spirit and scope of the present invention, many other variations or modifications that conform to the principles of the present invention can still be directly determined or deduced from contents disclosed in the present invention. Therefore, the scope of the present invention should be understood and recognized as covering all these other variations or modifications.

The invention claimed is:

1. A refrigerator, comprising:

a cabinet, in which are defined a cooling chamber located at a lower part and at least one storage compartment located above the cooling chamber;

an evaporator, disposed in the cooling chamber and configured to cool airflow entering the cooling chamber to form cooled airflow;

a centrifugal fan, comprising a volute and an impeller disposed in the volute, and configured to promote the cooled airflow to flow into the at least one storage compartment, wherein a rotation axis of the impeller is inclined but not perpendicular with respect to a vertical line; and an air supply duct, detachably connected with the volute and communicating with a volute air outlet, and configured to deliver the cooled airflow into the at least one storage compartment, wherein the centrifugal fan is located behind the evaporator, and the air supply duct is located behind the centrifugal fan;

the volute comprises:

a lower box body opened at both an upper part and a rear end, and an upper cover body buckled on the lower box body and opened at both a lower part and a rear end, the rear end of the upper cover body and the rear end of the lower box body defining the volute air outlet; and the air supply duct comprises a duct front cover plate located at a front side and a duct rear cover plate located at a rear side, the duct front cover plate being detachably connected with the upper cover body, and the duct rear cover plate being detachably connected with the lower box body.

2. The refrigerator according to claim 1, wherein the duct rear cover plate comprises a rear vertical plate section located at a lower part and vertically extending and a joint section bent and extending forwards and downwards from a lower end of the rear vertical plate section, and the joint section and a lower end of the duct front cover plate define a duct air inlet communicating with the volute air outlet; and the duct rear cover plate is detachably connected with the lower box body through the joint section.

3. The refrigerator according to claim 2, wherein the joint section comprises a horizontal straight section located at a front-most side and extending forwards and backwards, a first vertical plate vertically extending downwards is formed at a front end of the horizontal straight section, the first vertical plate extends from one transverse side of the horizontal straight section to the other side, and at least one first buckle protruding forwards is formed on a front vertical face of the first vertical plate;

a second vertical plate vertically extending downwards is formed at a rear end of a bottom wall of the lower box body, and the second vertical plate extends from one transverse side of the bottom wall of the lower box body to the other side;

first notches corresponding to and fitting with the at least one first buckle one-to-one are formed in a lower end of the second vertical plate; and the first buckle is buckled into the corresponding first notch and is hooked with a front vertical face of the second vertical plate, so as to assemble the lower box body and the duct rear cover plate.

4. The refrigerator according to claim 2, wherein a third vertical plate extending upwards is formed at a rear end of a top wall of the upper cover body, and the third vertical plate extends from one transverse side of the top wall of the upper cover body to the other side;

the duct front cover plate comprises a front vertical plate section located at the lower part and vertically extending, a transverse dimension of the front vertical plate section is equal to or greater than that of the third vertical plate, and at least one second buckle protruding forwards is formed on a front wall surface of the front vertical plate section;

at least one second notch corresponding to and fitting with the at least one second buckle one-to-one is formed at an upper end of the third vertical plate; and the second buckle is buckled into the corresponding second notch and is hooked with a front vertical face of the third vertical plate, so as to assemble the upper cover body and the duct front cover plate.

5. The refrigerator according to claim 2, wherein a section defined by the rear vertical plate section and the joint section is marked as a lower plate section of the duct rear cover plate; and a scaling portion is formed at an inner side of each of two transverse ends of the lower plate section, and the two scaling portions both extend forwards into the volute, so as to seal two transverse sides of a junction of the duct air inlet and the volute air outlet.

6. The refrigerator according to claim 1, wherein when the upper cover body and the lower box body are connected in a buckling manner, a side wall of the upper cover body is located at an inner side of a side wall of the lower box body, so as to define a volute air duct in the volute by using the side wall of the upper cover body and a top wall of the upper cover body as well as a bottom wall of the lower box body.

7. The refrigerator according to claim 1, wherein a volute air inlet is formed on a top wall of the upper cover body; and an included angle between the rotation axis of the impeller and the vertical line is 20° to 35°.

8. The refrigerator according to claim 1, wherein a horizontal distance between a front end face of the volute and a rear end face of the evaporator is 15 mm to 35 mm.

9. The refrigerator according to claim 1, wherein the cabinet comprises a freezing liner located at the lowermost side, and the cooling chamber is defined in the freezing liner;

the storage compartment comprises a freezing chamber defined by the freezing liner and located above the cooling chamber; and the centrifugal fan is configured to promote the cooled airflow to flow into the freezing chamber through the air supply duct.

10. A refrigerator, comprising:

a cabinet, in which are defined a cooling chamber located at a lower part and at least one storage compartment located above the cooling chamber;

an evaporator, disposed in the cooling chamber and configured to cool airflow entering the cooling chamber to form cooled airflow;

a centrifugal fan, comprising a volute and an impeller disposed in the volute, and configured to promote the cooled airflow to flow into the at least one storage compartment; and an air supply duct, detachably connected with the volute and communicating with a volute air outlet, and configured to deliver the cooled airflow into the at least one storage compartment, wherein the centrifugal fan is located behind the evaporator, and the air supply duct is located behind the centrifugal fan, and wherein the volute comprises:

a lower box body opened at both an upper part and a rear end, and an upper cover body buckled on the lower box body and opened at both a lower part and a rear end, the rear end of the upper cover body and the rear end of the lower box body defining the volute air outlet; and the air supply duct comprises a duct front cover plate located at a front side and a duct rear cover plate located at a rear side, the duct front cover plate being detachably connected with the upper cover body, and the duct rear cover plate being detachably connected with the lower box body.

11. The refrigerator according to claim 10, wherein the duct rear cover plate comprises a rear vertical plate section located at a lower part and vertically extending and a joint section bent and extending forwards and downwards from a lower end of the rear vertical plate section, and the joint section and a lower end of the duct front cover plate define a duct air inlet communicating with the volute air outlet; and the duct rear cover plate is detachably connected with the lower box body through the joint section.

12. The refrigerator according to claim 11, wherein the joint section comprises a horizontal straight section located at a front-most side and extending forwards and backwards, a first vertical plate vertically extending downwards is formed at a front end of the horizontal straight section, the first vertical plate extends from one transverse side of the horizontal straight section to the other side, and at least one first buckle protruding forwards is formed on a front vertical face of the first vertical plate;

a second vertical plate vertically extending downwards is formed at a rear end of a bottom wall of the lower box body, and the second vertical plate extends from one transverse side of the bottom wall of the lower box body to the other side;

first notches corresponding to and fitting with the at least one first buckle one-to-one are formed in a lower end of the second vertical plate; and the first buckle is buckled into the corresponding first notch and is hooked with a front vertical face of the second vertical plate, so as to assemble the lower box body and the duct rear cover plate.

13. The refrigerator according to claim 11, wherein a third vertical plate extending upwards is formed at a rear end of a top wall of the upper cover body, and the third vertical plate extends from one transverse side of the top wall of the upper cover body to the other side;

the duct front cover plate comprises a front vertical plate section located at the lower part and vertically extending, a transverse dimension of the front vertical plate section is equal to or greater than that of the third vertical plate, and at least one second buckle protruding forwards is formed on a front wall surface of the front vertical plate section;

at least one second notch corresponding to and fitting with the at least one second buckle one-to-one is formed at an upper end of the third vertical plate; and the second buckle is buckled into the corresponding second notch and is hooked with a front vertical face of the third vertical plate, so as to assemble the upper cover body and the duct front cover plate.

14. The refrigerator according to claim 11, wherein a section defined by the rear vertical plate section and the joint section is marked as a lower plate section of the duct rear cover plate; and a scaling portion is formed at an inner side of each of two transverse ends of the lower plate section, and the two scaling portions both extend forwards into the volute, so as to seal two transverse sides of a junction of the duct air inlet and the volute air outlet.

15. The refrigerator according to claim 10, wherein when the upper cover body and the lower box body are connected in a buckling manner, a side wall of the upper cover body is located at an inner side of a side wall of the lower box body, so as to define a volute air duct in the volute by using the side wall of the upper cover body and a top wall of the upper cover body as well as a bottom wall of the lower box body.

16. The refrigerator according to claim 10, wherein a volute air inlet is formed on a top wall of the upper cover body; and an included angle between a rotation axis of the impeller and a vertical line is 20° to 35°.

17. The refrigerator according to claim 10, wherein a horizontal distance between a front end face of the volute and a rear end face of the evaporator is 15 mm to 35 mm.

* * * * *